United States Patent [19]

Lynch

[11] 4,334,692

[45] Jun. 15, 1982

[54] DETACHABLE UMBRELLA SUPPORT ASSEMBLY FOR A GOLF CART

[76] Inventor: Marvin P. Lynch, 11 Brice Rd., Pendennis Mount, Annapolis, Md. 21401

[21] Appl. No.: 86,101

[22] Filed: Oct. 18, 1979

[51] Int. Cl.[3] ..... B60R 11/00

[52] U.S. Cl. ..... 280/79.1 A; 135/16; 224/274; 248/226.2; 248/539

[58] Field of Search ..... 296/102; 280/79.1 A, 280/62, 170, 175, DIG. 5; 224/274, 42.45 R; 248/539, 226.2, 226.5; 24/204; 135/16

[56] References Cited

U.S. PATENT DOCUMENTS

| | | | |
|---|---|---|---|
| D. 187,858 | 5/1960 | Pollock | 280/DIG. 5 |
| 712,651 | 11/1902 | Collier | 296/102 |
| 2,514,266 | 7/1950 | Walsloger | 224/42.45 R |
| 2,777,657 | 1/1957 | Zent | 248/539 |
| 4,013,315 | 3/1977 | West | 280/DIG. 5 |
| 4,063,704 | 12/1977 | Rother | 24/204 |

FOREIGN PATENT DOCUMENTS

| | | | |
|---|---|---|---|
| 412238 | 11/1945 | Italy | 280/289 S |

*Primary Examiner*—Joseph F. Peters, Jr.
*Assistant Examiner*—Ross Weaver
*Attorney, Agent, or Firm*—Sughrue, Mion, Zinn, Macpeak & Seas

[57] ABSTRACT

An umbrella support assembly designed to be clamped to the seat-back brace members of a pair of side-by-side seats in a conventional golf cart. The assembly includes a forwarding extending member whose free end is located between the two seats of the golf cart. A socket and strap sub-assembly is fixed to the free end for receiving the handle of a conventional golf umbrella and holding the umbrella in an upright position. A pair of Velcro straps is fixed to the socket securely clamping the umbrella to the sub-assembly.

7 Claims, 5 Drawing Figures

DETACHABLE UMBRELLA SUPPORT ASSEMBLY FOR A GOLF CART

BACKGROUND OF THE INVENTION

1. Field of the Invention

This invention relates generally to the field of golf carts and similar open vehicles and more particularly, to an umbrella support assembly which can be attached to conventional golf carts for supporting a conventional umbrella in an upright position over the heads of the occupants of a golf cart, thereby shielding the occupants from sun and rain.

2. Description of the Prior Art

Generally, there are two types of conventional golf carts. The first type, and by far the most common, is open at the top, and, therefore, the occupants of the golf cart are completely exposed to the sun's rays and to rain. The second, less common type has a canopy or surrey top permanently fixed to the golf cart as shown, for example in U.S. Pat. No. 4,037,614. The second type of golf cart is more expensive to purchase and it is also more expensive to maintain since the canopy and its support members can be damaged by golfers driving the cart under low hanging tree branches. Furthermore, since the canopy is constantly exposed to the elements, it soon wears out and must be replaced.

Thus, there is a need for an inexpensive and relatively easy-to-use support assembly which can be easily attached to existing conventional golf carts for holding a conventional umbrella in such a position that the umbrella serves as a canopy.

Even though umbrella support assemblies are known for other purposes, to applicant's knowledge, there is no umbrella support assembly specifically constructed for being detachably mounted to existing conventional golf carts. Prior art umbrella support assemblies for such objects as bicycles and horses are shown, for example, in the following U.S. Pat. Nos.: 498,224; 504,900; 690,342; and 846,315.

SUMMARY OF THE INVENTION

The general object of this invention is to provide a novel umbrella support assembly specifically designed so that it can be detachably secured to a conventional open golf cart or similar vehicle in such a manner that the assembly will support a conventional umbrella in such a position so as to shield the occupants of the golf cart from rain and sun.

In summary, one embodiment of the invention consists of a support assembly which can be detachably clamped to the rear seat supports of a conventional golf cart or similar vehicle. A forwardly extending member of the assembly has a free end which extends into the space between the two seats of a conventional golf cart. A socket is fixed to the end of the free end of the member and is designed to receive the handle of a conventional golf umbrella and hold the umbrella in a substantially vertical position so that the umbrella canopy shields the golf cart's occupants from rain and sunshine. A pair of Velcro straps clamps the umbrella to the socket.

DETAILED DESCRIPTION OF THE PREFERRED EMBODIMENT

Figure 1:
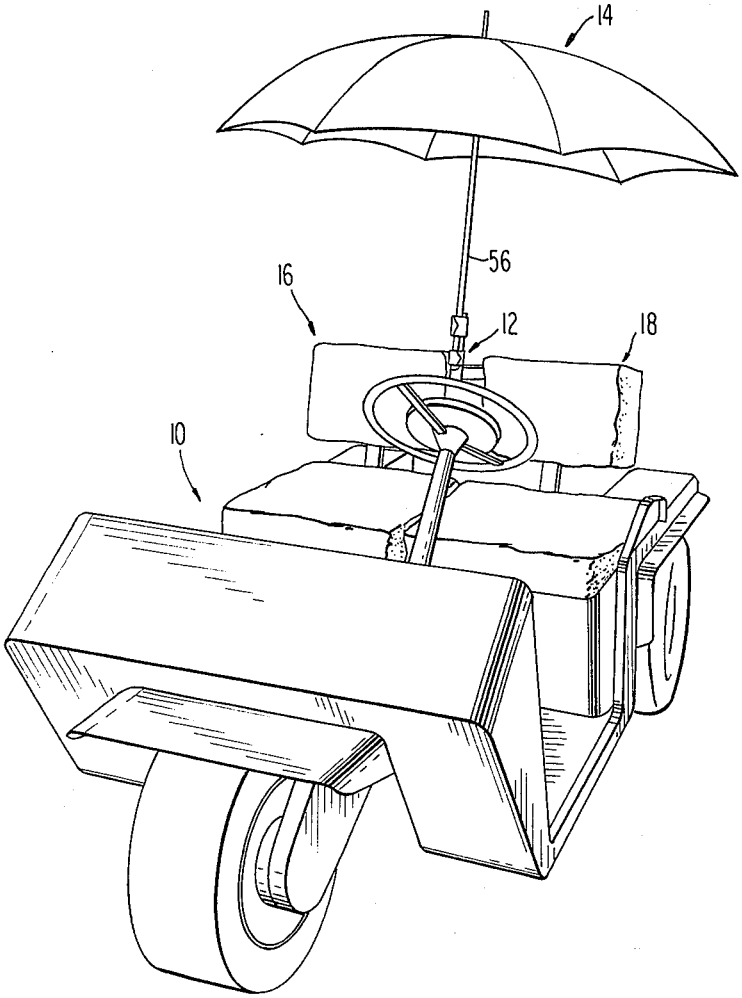
FIG. 1 is a perspective view of a conventional golf cart showing an umbrella mounted in my novel umbrella support assembly which has been mounted on the golf cart.

The drawing and following description relate to preferred embodiment of my invention which was designed to be detachably secured to a conventional Melex or Easy Go golf carts. Of course, obvious variations of the preferred embodiment can be made to adapt the invention to other manufacturers' golf carts without departing from the basic inventive concept. Furthermore, even though the preferred embodiment is a detachable umbrella support assembly which can be attached and detached from a golf cart at will, it is clear that the same basic design can be altered to provide a permanent or semi-permanent mounting of the umbrella support assembly to a golf cart.

FIG. 1 shows a conventional golf cart 10, in this case a Melex or Easy Go cart, on which is mounted my novel umbrella support assembly 12 supporting an open umbrella 14 between the two seats 16 and 18.

FIGS. 2–5 show the details of the preferred embodiment of my invention as designed for use with the seat-back supports of a Melex or Easy Go golf cart.

Figure 2:
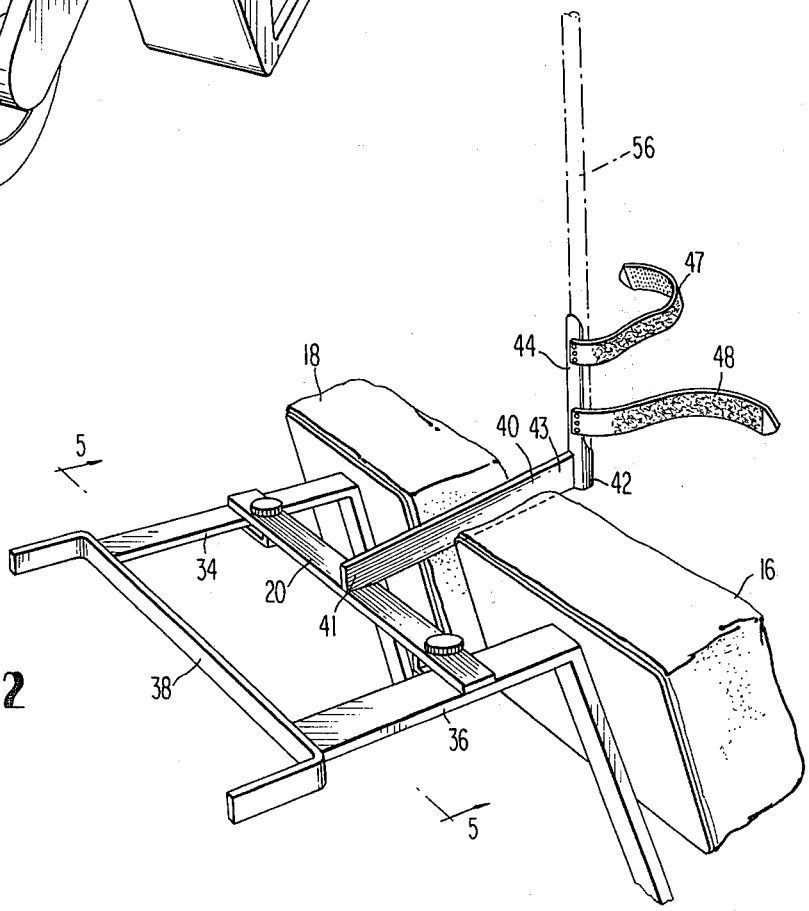
FIG. 2 is another perspective view showing in more detail the exact manner in which a preferred embodiment of my support assembly is mounted on the seat back support members of a Melex or Easy Go golf cart.
Figure 3:
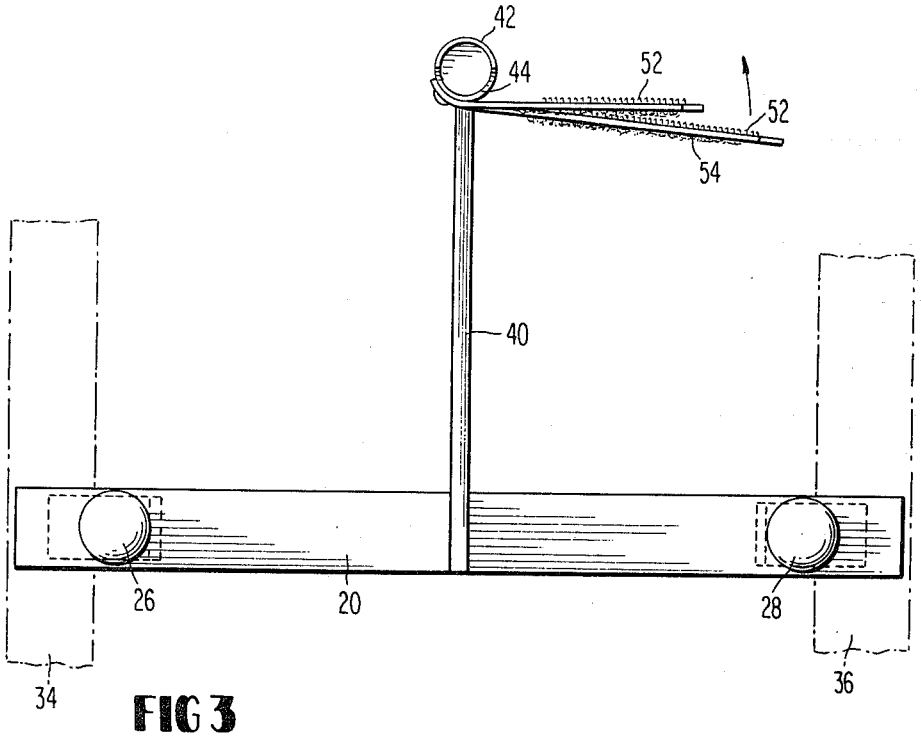
FIG. 3 is a top plan view of my novel umbrella support assembly.
Figure 4:
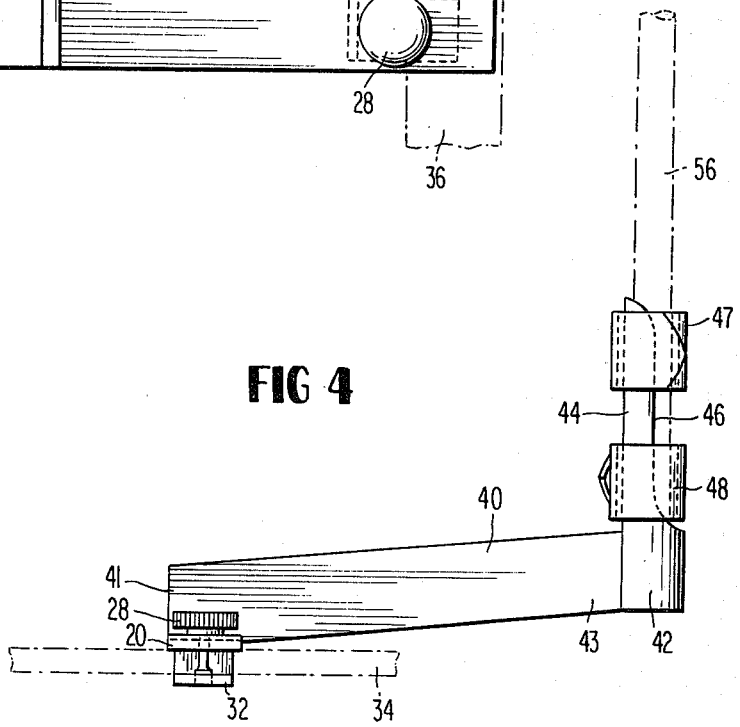
FIG. 4 is a side view of FIG. 3 and shows the Velco straps wrapped around the handle or staff of a golf umbrella.
Figure 5:
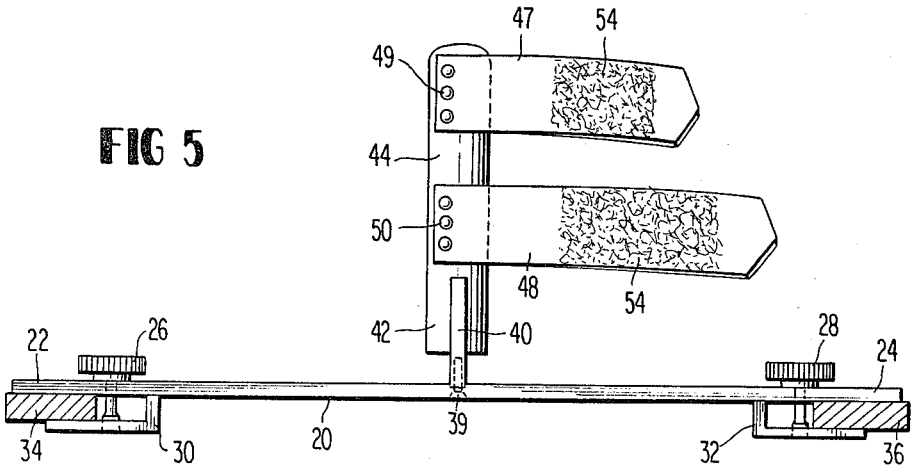
FIG. 5 is a cross-sectional view taken along line 5—5 of FIG. 2.

More specifically, the preferred embodiment of my novel umbrella support assembly includes a first horizontal support bar 20 whose opposite end portions 22 and 24 contain bore holes for receiving the respective clamp screws 26 and 28 whose lower ends are threaded. L-shaped flanges 30 and 32 are welded to the opposite ends of the bar 20 and contain threaded openings which are in vertical alignment with the bores formed in the opposite ends of the bar 20. The spacing between bar 20 and the flanges 30 and 32 is sufficiently wide to receive that part of the golf cart to which the assembly is to be attached. In this case, and as most clearly shown in FIG. 2, the horizontal seat back support members 34 and 36 fit into the gaps between the flanges 30 and 32 and the bar 20. The bar 20 is then securely clamped to the support members 34 and 36 by tightening down on the clamp screws 26 and 28 to draw the hinges 30 and 32 towards the bar 20. As shown in FIG. 2, a bracket 38 for holding golf bags is fixed to the free ends of the support members 34 and 36.

A forwardly extending bar 40 is secured, such as by welding or by screws 39, at its fixed end 41 to the horizontal bar 20. The bar 40 is of sufficient length so that it extends between the two seats 16 and 18 so that its free end 43 projects slightly forwardly of the seat backs. All that is necessary is that bar 40 be sufficiently long so that, when an umbrella is mounted in my novel support assembly, the umbrella will be positioned over the heads of the occupants of the golf cart so that the occupants are shielded from rain and sunshine. Secured, such as by screws or by welding, to the free end 43 of the forward extending bar 40 is a hollow, tubular socket member whose interior bore is of generally circular shape and of sufficient size to receive the handle and staff of any conventional golf umbrella. The bottom of socket 42 is closed to prevent the umbrella from falling through the socket.

The socket 42 forms a closed cylinder at its lower end but has an upperwardly extending top portion 44 which is only approximately semi-circular in shape leaving a substantially semi-circular elongated open portion 46 through which the umbrella handle or staff is exposed. A pair of Velcro straps 47 and 48 is fixed to this top portion 44 by rivets 49 and 50, for example. Velcro is a trademark for the well known nylon self-locking strap of the hook and pile type as clearly shown in FIG. 3. More specifically, one surface of each of the straps 47 and 48 is covered with a mat of nylon hooks 52 and the opposite surface is covered with a mat of nylon pile 54. Thus, when an umbrella handle or staff 56 is inserted into the socket 42, the straps 47 and 48 are tightly wrapped around the umbrella staff 56 and then locked upon themselves by means of the hook and pile arrangement, thereby securely locking the umbrella staff in a stable vertical position against the upper portion 44 of the socket member 42.

Thus, it is clear from the foregoing description and drawing that I have invented a novel accessory for a conventional open-top golf cart. The accessory is an umbrella support assembly which can be attached to any conventional golf cart. Even though I have illustrated and described the preferred embodiment of my support assembly for use with a Melex or Easy Go golf cart, obvious modifications of the invention can be made to adapt it to other golf cart constructions. Furthermore, it is clear that, for a permanent or semi-permanent installation on a golf cart, holes can be drilled in the seat back support members 34 and 36 for receiving the clamp screws 26 and 28 or conventional bolts and nuts which would either permanently or semi-permanently secure the umbrella support assembly to the members 34 and 36. However, in the preferred embodiment of the invention, the umbrella support assembly is purposely made detachable so that the assembly may be detached from one golf cart and attached to another. The assembly may be made from conventional aluminum bar stock and tubing.

As required by the patent statutes, I have described and illustrated in detail a preferred embodiment of my invention. Of course, obvious modifications of this preferred embodiment can be made without departing from the scope of my invention which is limited only by the following claims.

I claim:

1. An umbrella support assembly for attachment to a golf cart of the type having side-by-side seats and respective seat back support members, said assembly comprising:

first elongated horizontal support means adapted to be attached at opposite ends thereof to the seat back support members;

second elongated horizontal support means secured at one end thereof substantially perpendicularly to said first support means at a point intermediate said opposite ends thereof, and having a free end for projecting forwardly between the seats of the golf cart; and bracket means secured to said free end of said second support means for detachably mounting an umbrella in a substantially vertical position such that the umbrella's canopy will cover the heads of occupants of the golf cart seats.

2. An umbrella support as defined in claim 1 further comprising clamping means on said opposite ends of said first support means for clamping said first support means to the seat back support members.

3. An umbrella support assembly as defined in claims 1 or 2 wherein said bracket means comprises substantially vertically extending socket means for receiving the lower end of an umbrella shaft and holding the shaft in a substantially vertical position.

4. An umbrella support assembly as defined in claim 3 wherein said bracket means further comprises locking means for securing the umbrella shaft to said socket means.

5. An umbrella support assembly as defined in claim 4 wherein said locking means comprises strap means fixed at one end thereof to said socket means for encircling an umbrella staff and locking it in said socket means.

6. An umbrella support assembly as defined in claim 5 wherein the opposite surfaces of each of said straps have complementary locking means thereon for locking each strap upon itself.

7. An umbrella support assembly as defined in claim 1 wherein the golf cart is of the type having a pair of rearwardly extending horizontal brace members to which is fixed a golf bag-holding bracket, said assembly further comprising clamp means at the opposite ends of said first horizontal support means for detachably clamping the ends of said first horizontal support means to the respective horizontal braces.

* * * * *